United States Patent [19]

Fuerstman

[11] Patent Number: 4,941,573

[45] Date of Patent: Jul. 17, 1990

[54] PACKAGE IDENTIFICATION SYSTEM

[75] Inventor: Leland L. Fuerstman, Charlotte, N.C.

[73] Assignee: Color Ident Systems Corporation, Charlotte, N.C.

[21] Appl. No.: 199,009

[22] Filed: May 26, 1988

[51] Int. Cl.[5] ..... B65D 73/00

[52] U.S. Cl. ..... 206/459; 206/150

[58] Field of Search ..... 206/459, 150, 427, 428, 206/431

[56] References Cited

U.S. PATENT DOCUMENTS

| | | | |
|---|---|---|---|
| 2,976,629 | 3/1961 | Brixius et al. . | |
| 3,354,564 | 11/1967 | Falcone et al. . | |
| 3,599,362 | 8/1971 | Klober . | |
| 3,787,993 | 1/1974 | Lyon . | |
| 3,899,295 | 8/1975 | Halpern | 206/459 |
| 3,910,412 | 10/1975 | Vargo | 206/459 |
| 4,195,059 | 3/1980 | Whitcher et al. | 206/459 |
| 4,203,240 | 5/1980 | Goodwin . | |
| 4,207,982 | 6/1980 | Maxwell et al. | 206/459 |

*Primary Examiner*—Joseph M. Moy

*Attorney, Agent, or Firm*—Bell, Seltzer, Park & Gibson

[57] ABSTRACT

A package identification system for identifying the individual containers of a consumer pack of beverages packaged in sets of like containers is disclosed wherein each container in the set has its major surface area bearing a first indicia identical with other containers of the set for conveying information about the containers. A smaller identifying indicia is displayed on each container of the set with each identifying indicia being distinctly and visibly different from the smaller identifying indicia of each of the other containers of the set so that during consumption of the beverage, a user may readily distinguish his container from the other containers of the set.

15 Claims, 1 Drawing Sheet

PACKAGE IDENTIFICATION SYSTEM

FIELD OF THE INVENTION

This invention relates to package identification systems and more particularly to an identification system for identifying the individual containers of a consumer pack of beverages.

BACKGROUND OF THE INVENTION

It is common to package consumer beverage containers in sets having four, six or even more containers. Usually each container is identical to the others of the set with each container displaying thereon identical indicia over a major portion of the container. This indicia not only serves to convey information about the contents of the container, but it also depicts manufacturer and distributor trade information as well as trademark or trade dress configurations, colorations and words. Since each container in a set is virtually identical to the others, distinguishing between each container is almost impossible once the containers are separated from the ordered packaging arrangement. Usually, one's inability to distinguish between individual containers taken from a consumer pack has not been critical. At family gatherings or other social functions, mistakes of container identity causing one to drink from a container which previously had been used by another was considered at most impolite or unsanitary. Usually, such a mistake would create no more than a fear of passing to another the common cold.

Recently, however, the fear of acquiring communicable diseases has provoked concern among many. Although it is believed that the more loathsome diseases can be communicated only through the most intimate of a personal relationship, some have expressed concern that such diseases may be acquired by more distant activities such as drinking after another, e.g. mistakenly drinking from another's consumer beverage such as a soft drink or beer container. Without means identifying individual containers taken from a consumer pack, social occasions and even family gatherings quickly can be dampened by the nagging fear of whether the opened consumer beverage container just picked up and drunk from was the same one just recently laid down.

Although some prior patents have discussed ways for identifying various containers, it is believed they were limited by either their complexity and expense, or their appearance and impracticality. For example, U.S. Pat. Nos. 3,354,564 to Falcone et al and 2,976,629 to Brixius et al disclose identification insignia hanging or secured onto a container by pressure clips or other means. This approach is burdensome and detracts from the overall trade dress of the container. Likewise, using large, nonsimilar labels to identify different containers not only deemphasizes the manufacturer's and distributor's trademark and trade dress but it also obfuscates the important container content and labeling information usually mandated by governmental regulations.

It is accordingly an object of the present invention to provide a package identification system for identifying the individual containers of a consumer pack of beverages.

It is a further object of the present invention to provide a package identification system for readily identifying the individual containers of a consumer pack of beverages which does not distract from the manufacturer's or distributor's trade dress, trademark and container labeling information.

It is another object of this invention to provide a package identification system for identifying the individual containers of a consumer pack of beverages which is simple and inexpensive to implement.

SUMMARY OF THE INVENTION

These and other objects and advantages of the present invention are accomplished by a package identification system for identifying the individual containers of a consumer pack of beverages packaged in sets of like containers such as bottles, cans or boxes. Each of the containers in the set has the major area of its surface bearing a first indicia which is identical with each of the other containers of the set and which serves to convey information about the contents of the containers. Each of the containers in the set also has a smaller identifying indicia displayed thereon with the smaller identifying indicia of each container of the set being distinctly and visibly different from the smaller identifying indicia of each of the other containers of the set so that during consumption of the beverage a user may readily distinguish his container from the other containers of the set.

In one embodiment, the container includes a label with the first indicia and the identifying indicia printed onto the label. In another embodiment, the first indicia and the identifying indicia are printed onto the container. In the preferred embodiment, the identifying indicia is of a distinctly different color from the others of the set and comprises for each container a differently colored band encircling the container.

BRIEF DESCRIPTION OF THE DRAWINGS

Some of the objects and advantages of the present invention having been stated, others will be more fully understood from the detailed description which follows and by reference to the accompanyinG drawings in which.

DETAILED DESCRIPTION OF THE PREFERRED EMBODIMENT

Figure 1:
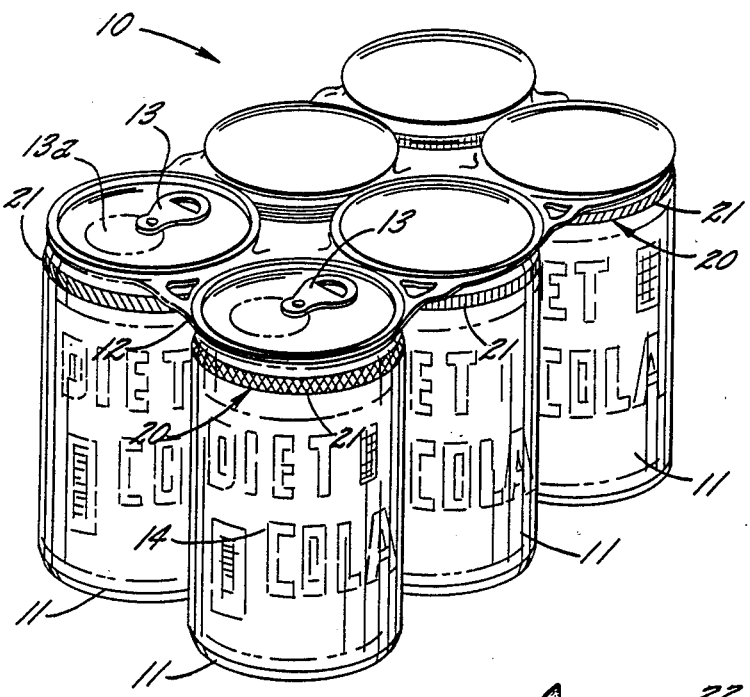
FIG. 1 is an isometric view of a consumer pack of beverage containers having the identification system in accordance with a first embodiment of the present invention, wherein a colored band is printed upon each container.

Referring now to the drawings, and more particularly to FIG. 1, there is shown a consumer pack 10 of beverage containers packaged in a set of like containers, which in the illustrated embodiment are six twelve ounce cans 11. As is conventional, the cans 11 are removably secured to each other as an integrated consumer pack 10 by means of a flexible, plastic retainer 12. Each can 11 also includes a top lift lid 13 for opening a pour area 13*a*.

Printed upon the major surface area of each of the cans 11 is a large indicia 14 representing the trade dress, trademarks, can content information, ingredient listings and other marks, dress, or explanation conventional to the container industry. When packaged as a consumer pack 10 without benefit of the present invention, all six cans 11 are initially indistinguishable since identical trade dress, trademarks and other container information are displayed thereon.

In accordance with the present invention, an identifying indicia 20, shown in FIG. 1 in the form of a colored band 21, is printed onto the cans 11. Each colored band 21 is very significantly smaller than the printed trade dress, trademarks and other container information, and is of a distinctly different color from the others of the set. For example, one band 21 may be red, one brown, and another green so that each can 11 from the set by virtue of the color of the band is readily identifiable from other cans drawn from the set. The colored bands 21 also can be any chosen width. However, when applied to a conventional can, colored band widths larger than about ½ may detract from the important trade dress, trademarks and other container information printed onto the can. Colored band widths smaller than about 1/16" may not be readily visible to an observer so that can identification is limited. Typically, the surface area of the identifying indicia 20 whether in the form of colored bands or other embodiments to be described herein will be no more than ten percent of the area borne by the larger first indicia to minimize visual distraction from the trade dress, trademark and other printed container information.

Figure 2:
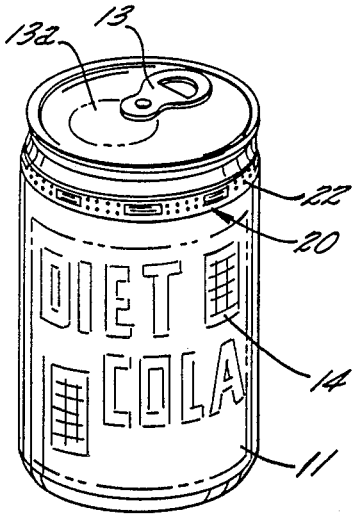
FIG. 2 is an isometric view of a container similar to those of FIG. 1 but showing a second embodiment of the invention, wherein the container has a colored decal band applied onto the container.
Figure 3:
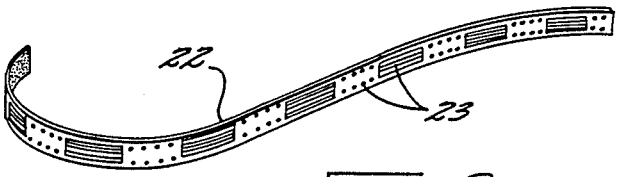
FIG. 3 is an isometric view of a colored decal band before application onto a container.

If during manufacture of the can 11, the identifying indicia 20 is not printed thereon, the indicia 20 subsequently may be applied to the can in a suitable manner such as a decal adhesive strip, or a subsequent printing operation. For example, as shown in FIG. 2, a different embodiment of the invention has the indicia 20 applied as a colored band in the form of a decal adhesive strip 22. In addition, the colored band 21, 22, whether printed directly onto the can 11 or applied as a decal adhesive strip 22, may include other identifying marks or information 23 in spaced relationship around the band. Such marks or information may include trademark words, logos, or alternating colors positioned within the band (FIG. 3).

Figure 4:
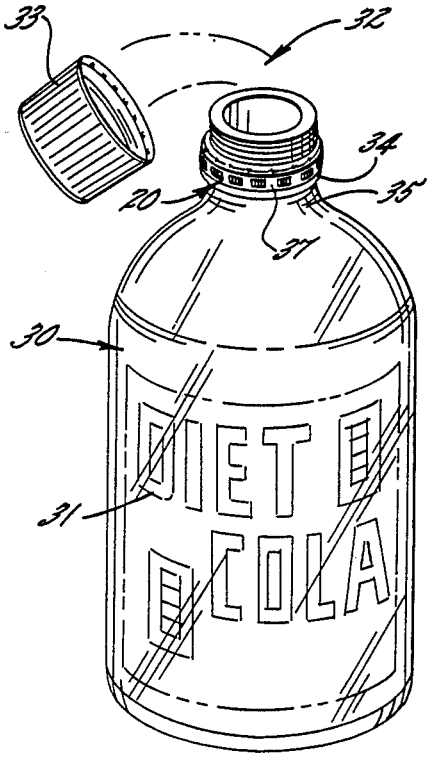
FIG. 4 is an isometric view of a bottle showing still another embodiment of the present invention, wherein a colored band is applied to the nonremovable portion of the closure cap.
Figure 5:
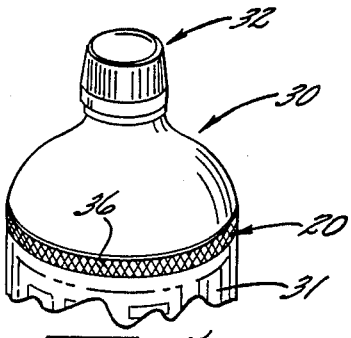
FIG. 5 is an isometric view of a portion of a bottle similar to that shown in FIG. 4 and showing another embodiment of the present invention, wherein a colored band is applied to the bottle side.

In accordance with the present invention, the indicia 20 also can be applied to containers other than cans. Referring now more particularly to FIGS. 4 and 5, there is shown an open-topped bottle 30 having an identifying indicia 20 applied to the bottle. As is conventional with many bottle designs, each bottle 30 includes an insulating sleeve member 31 also acting as a label for carrying trade dress, trademark and other container information. For closing the bottle top, a closure cap 32 having a removable cap member 33 and a nonremovable annular seal member 34 are threadably secured onto the bottle neck 35. Upon removal of the cap member 33, annular seal 34 remains secured to the bottle neck 35. Although the bottle 30 may have printed onto the side sleeve member 31 a colored identifying band 36 such as shown in FIG. 5, in the preferred embodiment illustrated in FIG. 4, the band of color is applied as an identifying decal or printed colored band 37 to the nonremovable annular member 34 secured onto the bottle neck 35. To distinguish the bottles 30 packaged as an integral consumer pack 10, each annular seal member 34 includes thereon a differently colored band from each other.

A further advantage of applying the identifying indicia 20 to the annular seal member 34 is the removed distance of the identifying indicia from the annular seal member. By locating the identifying indicia 20 a removed distance from the larger indicia 14 located on the bottle side, there is little chance that the identifying indicia would distract from manufacturer's or distributor's trade dress, trademark and other container information.

Figure 6:
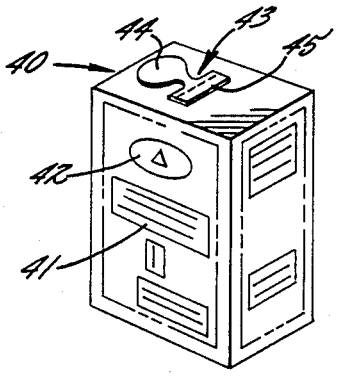
FIG. 6 is an isometric view of a carton container showing a different embodiment of the invention wherein a first geometrically configured identifying indicia is imprinted on the package label.
Figure 7:
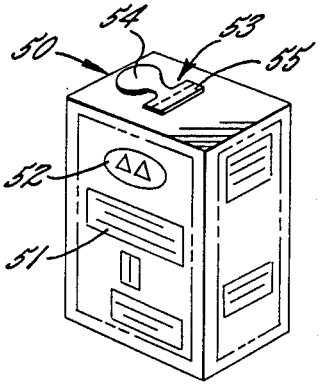
FIG. 7 is an isometric view of a carton container similar to the embodiment shown in FIG. 6 but having a second geometrically configured identifying indicia differing from that shown in FIG. 6 imprinted on the package label.

In addition to applying the indicia 20 of the present invention to the more common consumer packs of beverage cans or bottles, the indicia also can be applied to other consumer packs of beverages such as a set of carton containers. Referring now to FIGS. 6 and 7, respective first and second carton containers 40, 50 such as used for packaging fruit and other juices, are shown having labels 41, 51 applied to the carton side. As is conventional, the respective labels 41, 51 include thereon identical trademark, trade dress and other container information. However, as illustrated, means identifying each carton container packaged in a set includes a different geometrical pattern 42, 52 applied to the labels 41, 51 of each carton container within the set. Although the illustrated embodiment shows the first pattern 42 having a single, encircled triangle and the second pattern 52 having two encircled triangles, it is evident that almost any unique set of geometrical patterns can be used on a set of carton containers as long as the patterns are visibly distinct, but small enough to minimize distraction from the manufacturer's trade dress, trademark and other container information. Also, each geometrical pattern can be colorcoded to aid distinguishment.

Alternatively, or in combination with an indicia applied to the side label, a portion of the carton containers' pull tabs 43, 53 may be color coded. As noted in FIGS. 6 and 7, each carton container 40, 50 includes respective conventional pull tabs 43, 53 having circular seal members 44, 54 engaging a pour hole (not shown) and rectangular tab members 45, 55 secured to the carton containers' top for aiding maintenance of the seal members 44, 54 in sealing engagement with the pour area. When the seal members 44, 54 are removed, they are severed from the rectangular tab members 45, 55 which remain secured to the carton containers 40, 50. Since tab members 45, 55 remain secured, each tab member 45, 55 can be uniquely color coded. Such a color coding scheme applied only to tab members 45, 55 minimizes any interference with the trade dress, trademark and other container information which may otherwise occur if a pattern or colored band is applied to the side labels 41, 51. As a further embodiment, the geometrically configured mark displayed on the carton container of either FIG. 6 or FIG. 7 could be applied to each carton container of the set. By making each similar mark on each carton container a different color, each carton container in a set can readily be distinguished from each other.

It is evident, that each of the illustrated embodiments are not restrictive of the present invention. An identifying indicia in accordance with the present invention can be applied to almost any variety of a consumer pack of beverage containers packaged in sets of like containers. Depending on the container design, trade dress, trademarks and other container information listed thereon, the identifying indicia can be applied as a color coded band, symbol, word mark or geometrical pattern as long as the indicia is visibly distinct, but not so large as to distract from the trade dress, trademark and other container information listed thereon.

The foregoing embodiments are to be considered illustrative rather than restrictive of the invention and those modifications which come within the meaning and range of equivalents of the claims are to be included therein.

That which is claimed is:

1. An identification system for distinguishing among the individual containers of a consumer package of beverages comprising a plurality of beverage containers substantially identical in size and shape to each other and containing identical contents therein;

means removably holding said containers together for packaging said containers as an integrated consumer package of beverages;

a first indicia borne on the major surface area of each container with each indicia borne on each container being identical with the indicia of each of the other containers and serving to convey information about the beverage such as the name, origin, ingredients and the like;

a smaller identifying indicia positioned on a minor surface area of each container, with the smaller identifying indicia on each container being distinctly and visibly different from the smaller, identifying indicia on each of the other containers in the consumer package so that during consumption of the beverage a user may readily distinguish his container from the other containers in the package.

2. A package identification system according to claim 1 wherein each of said identifying indicia is of a distinctly different color from the other containers in the package.

3. A package identification system according to claim 1 wherein said identifying indicia comprises a colored band encircling said container and wherein each of said colored bands for each container is of a distinctly different color from the other containers in the package.

4. A package identification system according to claim 1 wherein said container includes a label, with said first indicia and said identifying indicia printed on the label.

5. A package identification system according to claim 1 wherein said first indicia and said identifying indicia are printed directly on the container.

6. A package identification system according to claim 1 wherein said identifying indicia comprises an identical geometrically configured mark printed on each container and wherein each of said printed marks is of a distinctly different color from the other containers in the package.

7. A package identification system according to claim 1 wherein said identifying indicia comprises a geometrically configured mark printed on each container and wherein each of said printed marks is of a distinctly different geometric configuration from the other containers in the package.

8. A package identification system according to claim 1 wherein said identifying indicia comprises an identical word mark printed on each container and wherein each of said word marks is of a distinctly different color from the other containers in the package.

9. A package identification system according to claim 1 wherein each container includes a pour opening and closure means sealingly engaging said pour opening in a fluid tight seal, said closure means including removable and nonremovable portions with said smaller identifying indicia displayed upon said nonremovable portion, wherein said nonremovable portion is retained on said container and said identifying indicia displayed thereupon when said removable portion of said closure means is removed.

10. A package identification system according to claim 9 wherein said container is a bottle and said closure means comprises a closure cap having an upper removable portion for sealingly engaging said bottle in a fluid tight seal, and a nonremovable annual seal member detachable from said upper removable portion upon removal of said upper portion from said bottle so that when said fluid tight seal is broken, said nonremovable portion having said identifying indicia thereon remains with said bottle.

11. A package identification system according to claim 9 wherein each of the nonremovable annual seal members is of a distinctly different color from the other containers in the package.

12. A package identification system as claimed in claim 3 wherein each of said colored bands includes a word mark incorporated therein.

13. An identification system for distinguishing among the individual bottles of a consumer package of beverages comprising a plurality of beverage bottles substantially identical in size and shape to each other and containing identical contents therein, each bottle including a closure cap, said closure cap having an upper removable portion for sealingly engaging said bottle in a fluid tight seal, and a non-removable annular seal member detachable from the upper removable portion upon opening of the closure cap and removal of the upper portion from the bottle, means removably holding said bottles together for packaging said bottles as an integrated consumer package of beverages, a first indicia borne on the major surface area of each bottle with each indicia borne on each bottle being identical with the indicia of each of the other bottles and serving to convey information about the beverage such as the name, origin, ingredients and the like;

a smaller, identifying indicia positioned on the nonremovable annular member of each closure cap, with each identifying indicia for each bottle being distinctly different from the other identifying indicia on each of the bottles in the consumer package so that during consumption of the beverage, a user may readily distinguish his bottle from the other bottles in the package.

14. The identification system according to claim 13 wherein said smaller, identifying indicia comprises a colored band encircling said annular seal member.

15. An identification system for distinguishing among the individual carton containers of a consumer package of beverages comprising a plurality of beverage carton containers substantially identical in size and shape to each other and containing identical contents therein, each carton container including a pour opening and closure means sealingly engaging said pour opening in a fluid tight seal, said closure means including removable and non-removable portions;

means removably holding said carton containers together for packaging said carton containers as an integrated consumer package of beverages;

a first indicia borne on the major surface area of each carton container, with each indicia borne on each container being identical with the indicia of each of the other containers to convey information about the beverage such as the name, origin, ingredients and the like;

a smaller identifying indicia displayed on said non-removable portion of said closure means, with the smaller, identifying indicia on each non-removable portion of each carton container being distinctly and visibly different from the smaller identifying indicia displayed on each of the other non-removable portions on each of the other carton containers in the consumer package so that during consumption of the beverage a user may readily distinguish his carton containers from the other carton containers in the package.

* * * * *